US006615498B1

(12) United States Patent
King et al.

(10) Patent No.: US 6,615,498 B1
(45) Date of Patent: Sep. 9, 2003

(54) FLEXIBLE MEMBER FOR A SHAVING RAZOR

(75) Inventors: Brian F. King, Orange, CT (US); Paul R. Dansreau, Shelton, CT (US); Michael J Sasuta, Milford, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/524,248

(22) Filed: Jun. 12, 2000

(51) Int. Cl.[7] ..... B26B 21/52
(52) U.S. Cl. ..... 30/527
(58) Field of Search ..... 30/524, 532, 533, 30/529, 538

(56) References Cited

U.S. PATENT DOCUMENTS

| | | | | |
|---|---|---|---|---|
| 2,844,870 A | | 7/1958 | Roces et al. | 30/85 |
| 5,535,518 A | | 7/1996 | Althus et al. | |
| 5,560,106 A | * | 10/1996 | Armbruster et al. | 30/527 |
| 5,771,591 A | * | 6/1998 | Armbruster et al. | 30/527 |
| 5,781,997 A | | 7/1998 | Ferraro et al. | |
| 5,813,119 A | | 9/1998 | Ferraro et al. | |
| 5,953,824 A | | 9/1999 | Ferraro et al. | |

FOREIGN PATENT DOCUMENTS

| | | | |
|---|---|---|---|
| EP | 0429174 | 5/1995 | B26B/21/22 |
| FR | 612211 | 9/1926 | |
| GB | 2116470 | 9/1983 | |
| GB | 2172236 | 9/1986 | |
| WO | WO 9320983 | 10/1993 | |
| WO | WO9836878 | 8/1998 | B26B/21/00 |

* cited by examiner

*Primary Examiner*—Douglas D. Watts
(74) *Attorney, Agent, or Firm*—Peter C. Richardson; Gregg C. Benson; Raymond D. Thompson

(57) ABSTRACT

A razor assembly having a razor cartridge designed for pivotal, swivel and torsional movement during shaving includes a handle and a flexible member having a first end connected to the handle at a pivot axis, a second free end extending beyond the handle and a longitudinal axis extending through the first and second ends of the flexible member. The razor cartridge, which has a major axis and one or more razor blades, is pivotally connected to the second free end of the flexible member for pivoting about an axis that is substantially parallel to the major axis of the razor cartridge. In addition, the second free end of the flexible member, and the razor cartridge pivotally connected thereto, are movable along an arcuate path centered at the pivot axis and are rotatable about an axis substantially parallel to the longitudinal axis of the flexible member.

29 Claims, 16 Drawing Sheets

FLEXIBLE MEMBER FOR A SHAVING RAZOR

FIELD OF THE INVENTION

The present invention is directed to razors, and more particularly to a flexible member for a razor that enables a razor cartridge attached to the flexible member for pivotal, swivel and torsional movement during a shaving stroke.

BACKGROUND OF THE INVENTION

The ability to obtain a close and comfortable shave depends upon the quality of the interface between the blades of a razor and the skin surface being shaved. Factors such as contours and/or crevices on a user's skin surface may create an imbalance of shaving forces on a razor, thereby degrading shave performance. In response to this problem, razors have been developed which utilize blades that flex in order to conform to the contours and/or crevices of an individual's skin surface. For example, commonly assigned U.S. Pat. No. 5,781,997 to Ferraro et al. discloses a flexible razor cartridge that can flex convexly and concavely during shaving to follow the contour of a skin surface. The '997 patent also includes a blade support having a compressible rubber-like material and that allows the blades to angularly and vertically deflect during shaving.

Commonly assigned U.S. Pat. No. 5,813,119 to Ferraro et al. discloses another flexible razor cartridge whereby the razor includes a support and at least one rotating pivot movably connected to the support for contacting portions of a razor cartridge. The razor cartridge is normally maintained in a neutral position, however, in response to forces exerted on the razor cartridge, the cartridge may rotate and slide back and forth between a first position and a second position.

There have also been efforts to provide razors having degrees of movement, whereby the entire razor cartridge is moveable relative to a razor handle. For example, PCT Publication 93/20983 and United Kingdom Patent GB 2,116,470 both disclose razors having razor cartridges that are capable of swiveling relative to a razor handle. Another system disclosed in United Kingdom Patent GB 2,172,236 permits swiveling and pivoting motion, however, the pivoting causes the blade movement to leave the rotational plane of the surface being shaved.

Commonly assigned U.S. Pat. No. 5,535,518, the disclosure of which is hereby incorporated by reference herein, discloses a four bar linkage system which allows for pivoting and swiveling of a razor cartridge in response to shaving forces.

Commonly assigned U.S. Pat. No. 5.953,824, the disclosure of which is hereby incorporated by reference herein, discloses a razor that allows a razor cartridge attached thereto to move relative to the razor in response to forces encountered during shaving. In certain embodiments, the razor cartridge is capable of swiveling and also pivoting about an axis normal to a central axis of the razor and normal to an imaginary axis defined by the points of attachments of the razor to a razor cartridge. The razor includes an engagement arm having a slot for controlling movement of the razor cartridge during shaving and during loading/unloading of the razor cartridge. As a result, the razor cartridge maintains an optimum shaving interface with a user's skin surface regardless of the angular differences between the razor cartridge and the razor during a shaving stroke.

SUMMARY OF THE INVENTION

These and other advantages of the present invention are described in further detail below.

Various embodiments of the present invention are directed to razors adapted to support a razor cartridge during shaving while permitting pivoting (axis $A_1$), torsional (axis $A_2$) and swiveling motion (axis $A_3$) of the razor cartridge relative to the razor in response to forces encountered during shaving. In one preferred embodiment, a razor assembly includes a razor handle and a flexible member having a first end connected to the handle at a pivot point. The razor handle may have an upper end and lower end with the first end of the flexible member being connected to the upper end of the razor handle. The flexible member desirably has a second free end projecting from the upper end of the razor handle, with a longitudinal axis extending through the first and second ends of the flexible member. The razor assembly also includes a razor cartridge having a major axis and having one or more razor blades, the razor cartridge being pivotally connected to the second free end of the flexible member for pivoting about an axis that is substantially parallel to the major axis of the razor cartridge. The second free end of the flexible member and the razor cartridge pivotally connected thereto are moveable along an arcuate path centered at the pivot point (i.e., swiveling motion about axis $A_3$) and are rotatable about an axis substantially parallel to the longitudinal axis of the flexible member (i.e., torsional motion about axis $A_2$). The axis $A_2$ may also extend from the upper end to the lower end of the handle, along the longitudinal axis of the handle. The second free end of the flexible member preferably includes a connecting element adapted for receiving the razor cartridge so that the razor cartridge may be connected thereto. In certain preferred embodiments, the connecting element at the second free end may include a substantially cylindrical shaped rod extending in a direction that is substantially normal to and/or intercepts the longitudinal axis of the flexible member. The razor cartridge may include an underside having one or more bearing surfaces adapted for engaging the substantially cylindrical shaped rod for connecting the razor cartridge with the second end of the flexible member. In certain embodiments, the bearing surfaces snap-fit over the outer surface of the substantially cylindrical shaped rod so that the razor cartridge may pivot about the rod in response to forces encountered during a shaving stroke. The razor cartridge and flexible member may be adapted for unidirectional pivoting motion of the razor cartridge or bi-directional pivoting motion of the razor cartridge relative to the flexible member in response to forces acting upon the cartridge during the shaving process.

The flexible member may also include a support gusset, such as a triangular shaped support gusset, extending from the second free end of the flexible member toward the first end thereof. The flexible member may also include a lateral support extending in a direction that intersects the longitudinal axis of the flexible member. The razor handle may include a rear portion or rear half and a front portion or front half, whereby the rear and front handle portions are connectable together for surrounding at least a portion of the flexible member. In other preferred embodiments, the handle has one piece that may be plastic or metal. In still further embodiments, the flexible member and handle are plastic and the flexible member is integrally molded with the handle. The handle preferably surrounds the first end of the flexible member with the second end of the flexible member projecting out from the handle.

Further advantages and characteristics of the invention are described in further detail below.

DETAILED DESCRIPTION OF THE PREFERRED EMBODIMENTS

Figure 1:
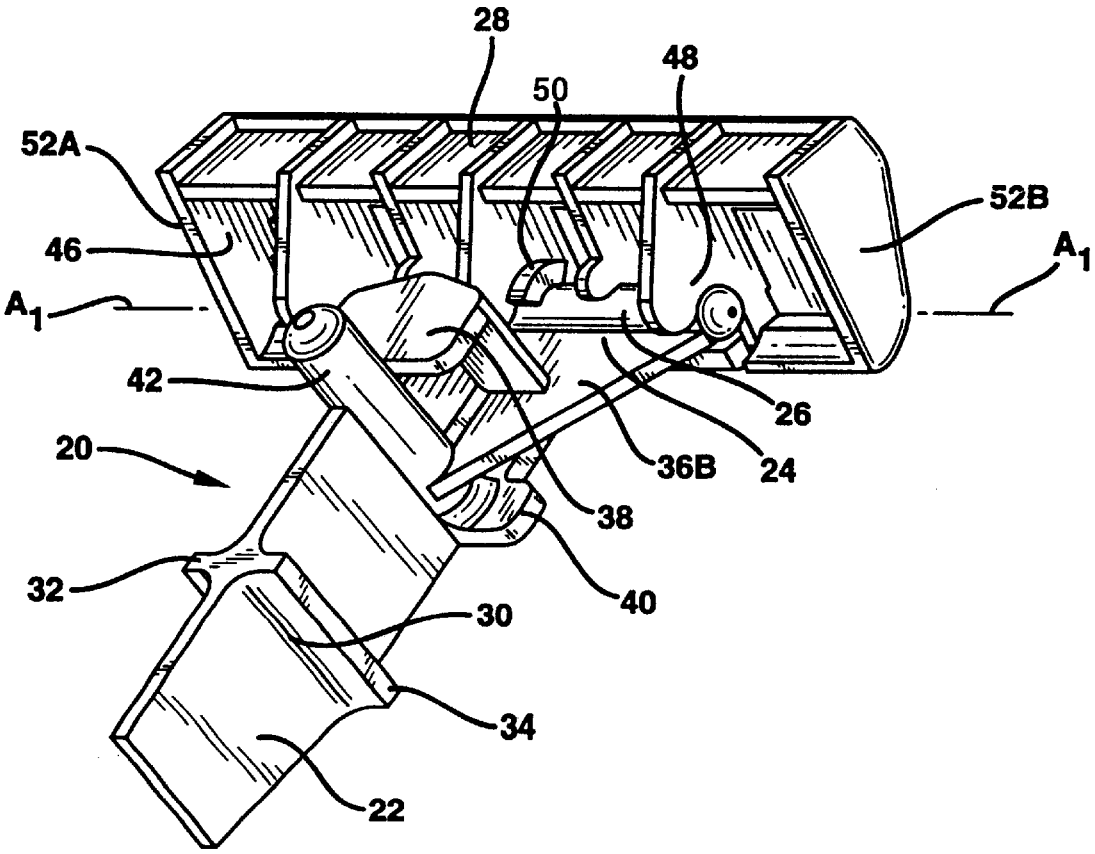
FIG. 1 shows an isometric rear side view of a flexible member for a razor having a razor cartridge attached thereto in accordance with one preferred embodiment of the present invention.
Figure 2:
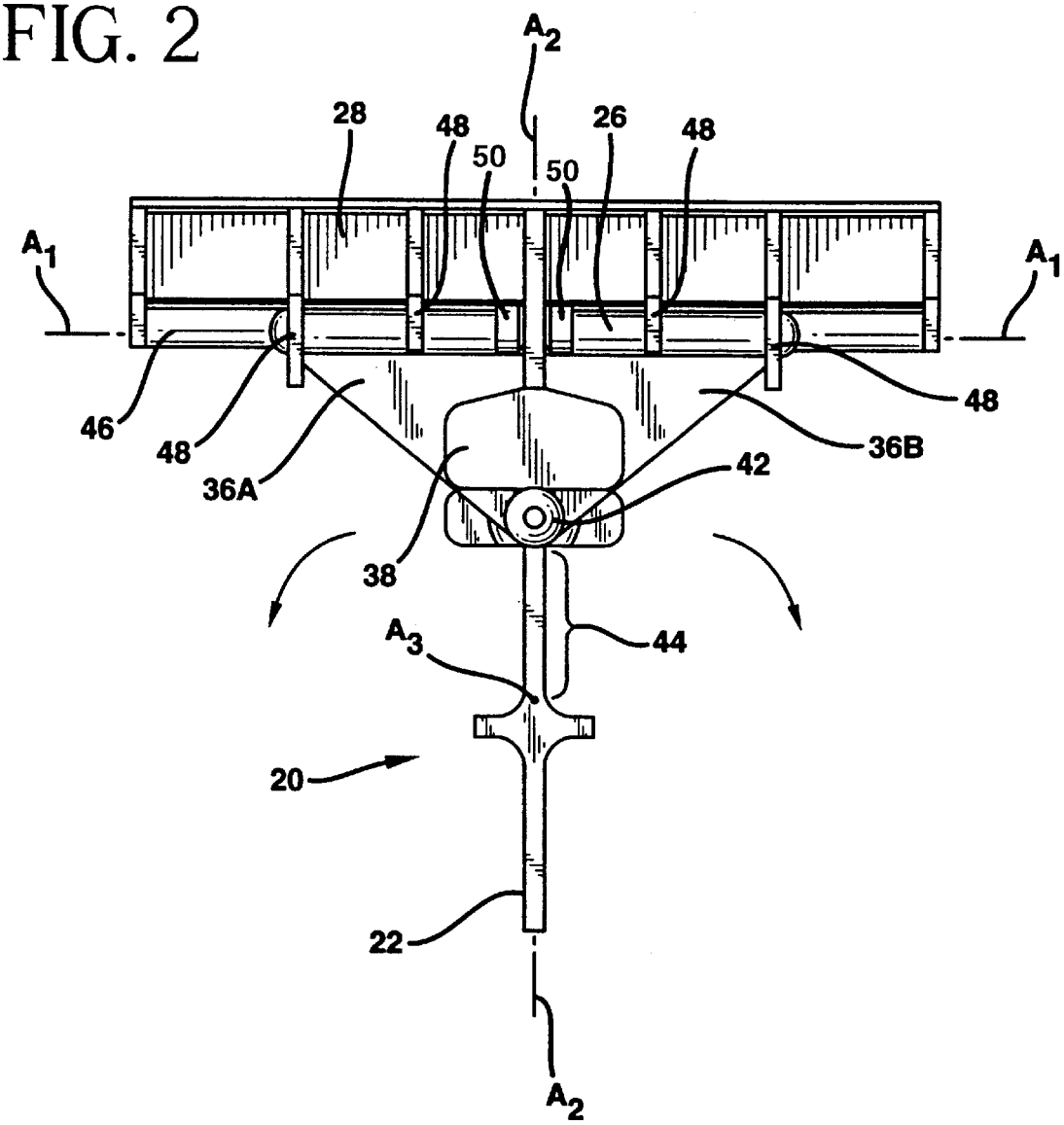
FIG. 2 shows a rear view of the flexible member and razor cartridge shown in FIG. 1.

FIGS. 1 and 2 show a flexible member 20 for a razor assembly in accordance with certain preferred embodiments of the present invention. The flexible member 20 has a first or lower end 22 that is preferably connectable to a razor handle and a second or upper end 24 remote therefrom that is preferably connectable to a razor cartridge. The flexible member desirably has a connecting element such as a substantially cylindrically-shaped rod 26 attached to the second end 24 thereof. The rod 26 has a longitudinal axis designated $A_1$. The substantially cylindrically-shaped rod 26 is preferably sized and shaped for having a razor cartridge 28 pivotally connected thereto so that the razor cartridge 28, which has one or more blades, may pivot about longitudinal axis $A_1$. The flexible member has a longitudinal axis $A_2$ extending between the first and second ends 22, 24 of the flexible member 20. The flexible member 20 also preferably includes a substantially cross-shaped lateral support 30 having a left side lateral support or flange 32 and a right side lateral support or flange 34. The flexible member 20 also includes left side and right side support gussets 36A and 36B extending from an underside of the rod 26 and the second end 24 of the flexible member 20 toward the first end 22 of the flexible member. In the embodiment shown in FIG. 1, the support gussets 36A, 36B extend from the cylindrical rod 26 to a visual indicator 42. The visual indicator 42 projects from the rear of the flexible member 20 and indicates the position of the flexible member 20 during a shaving operation. The flexible member 20 has an upper flange 38 and a lower flange 40. The upper and lower flanges 38, 40 extend in directions that are substantially perpendicular to a flexible web 44. The flexible web 44 is preferably a portion of the flexible member 20 that extends between the pivot point of the flexible member (i.e., axis $A_3$) and the upper and lower flanges 38 and 40. In preferred embodiments, most if not all of the swiveling motion of the flexible member (i.e., motion about axis $A_2$) and torsional motion of the flexible member (i.e., motion about axis $A_2$) occurs at the flexible web 44 of the flexible member. In preferred embodiments, most if not all of the torsional motion of the flexible member (i.e., motion about axis $A_2$) occurs in the support gussets 36A, 36B. However, in other preferred embodiments torsional motion may occur in the flexible web 44 of the flexible member (i.e., motion about axis $A_2$).

FIG. 2 shows a rear view of the flexible member 20, with the razor cartridge 28 pivotally connected to the substantially cylindrical-shaped rod 26. In certain preferred embodiments, the razor cartridge 28 has an underside 46 that includes bearing surfaces 48 that are sized and shaped to snap fit over the outer surface of the cylindrical rod 26. The bearing surfaces 48 are made of a resilient thermoplastic material so that the razor cartridge 28 may be releasably connected to the rod 26. As a result, razor cartridges may be selectively connected to and/or detached from the flexible member 20, such as when a first razor cartridge (i.e., a worn razor cartridge) is replaced with a substitute razor cartridge. Once the razor cartridge 28 has been pivotally secured to the rod, lateral locking elements 50 prevent and/or limit lateral movement of the razor cartridge 28 relative to the cylindrical rod 26 (i.e., movement along axis $A_1$). The lateral locking elements 50 also preferably guide the outer surface of rod 26 into engagement with the bearing surfaces 48. The razor cartridge 28 also includes end walls 52A and 52B provided at opposite ends of the razor cartridge that may or may not be used in conjunction with cylindrical rod 26 and may or may not be used in conjunction with the lateral locking elements 50. In further preferred embodiments, the rod 26 substantially cylindrical-shaped rod could extend into engagement with the side walls of the razor cartridge for preventing side-to-side or lateral movement of the razor cartridge. In other preferred embodiments, the rod 26 may be pivotally connected to the end walls of the razor cartridge. In these embodiments, the end walls may have concave-shaped bearing surfaces formed therein and the rod may be snap-fit into the bearing surfaces.

Figure 3:
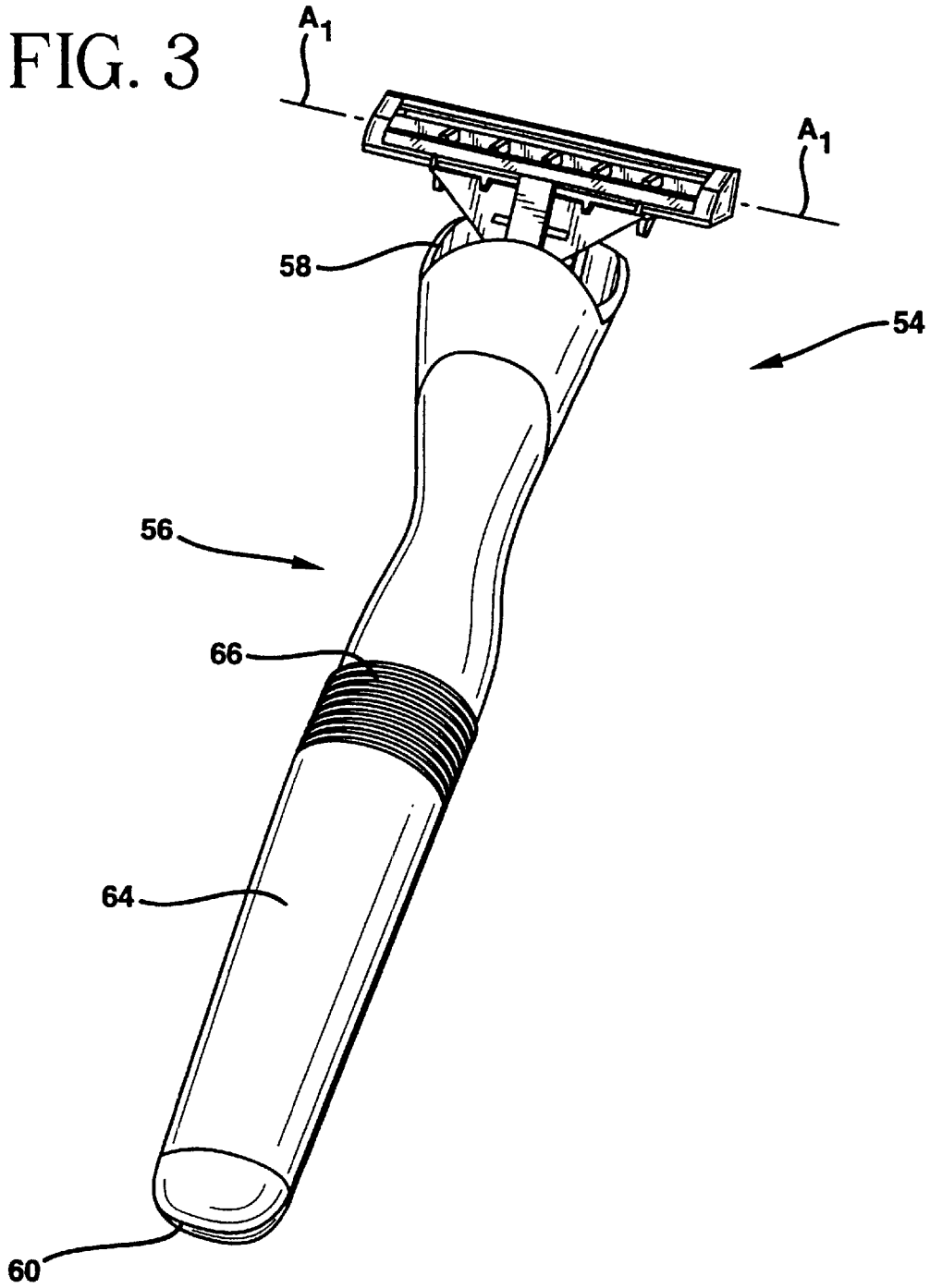
FIG. 3 shows an isometric front side view of a razor assembly including the flexible member and razor cartridge of FIGS. 1 and 2 in accordance with certain preferred embodiments of the present invention.
Figure 4:
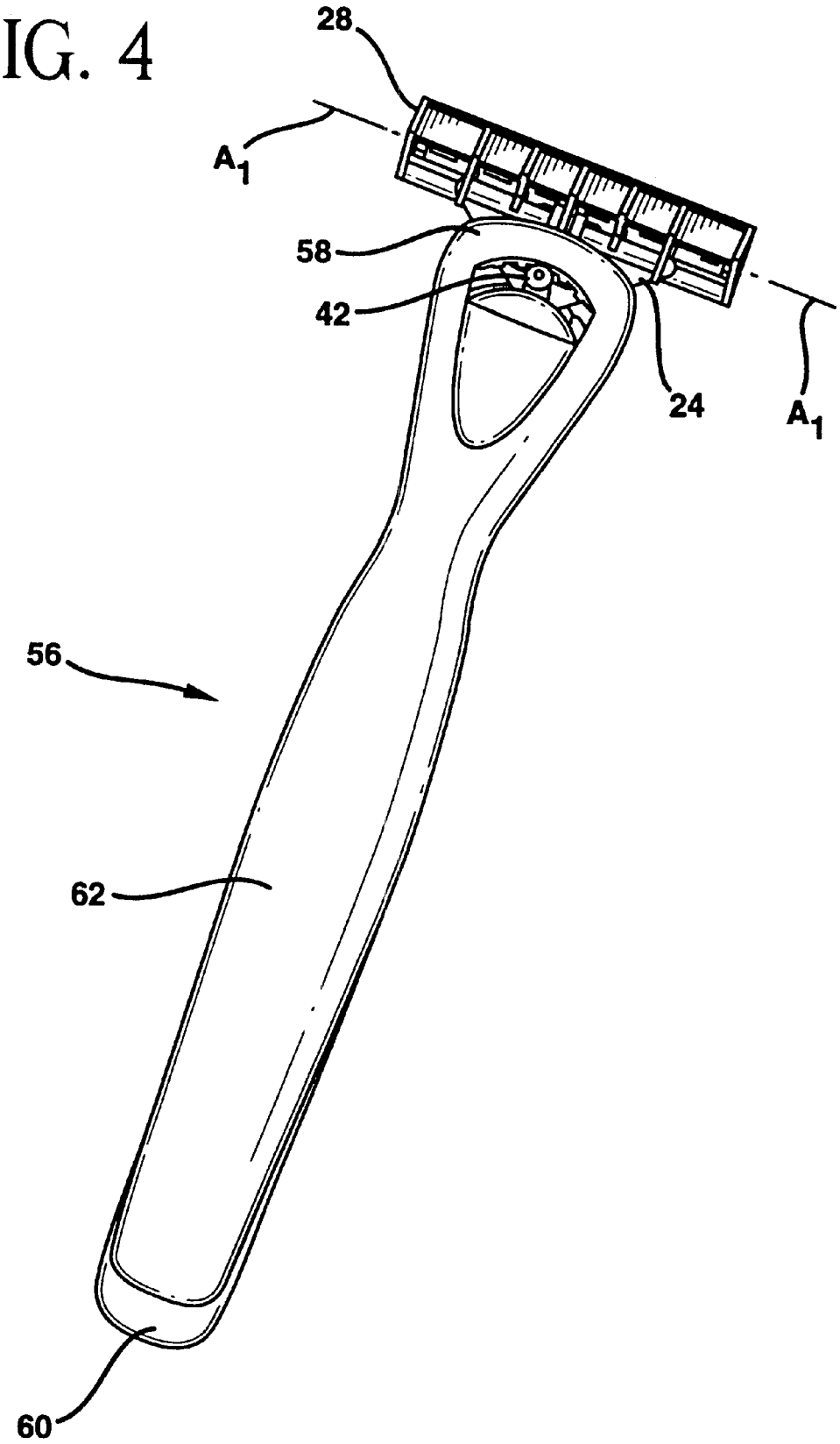
FIG. 4 shows a rear side view of the razor assembly shown in FIG. 3.

The flexible member 20 shown in FIGS. 1 and 2 may be connected to a handle. The connection may be a permanent connection or a releasable connection. For example, the flexible member may be releasably connected to the handle if the flexible member is disposable. FIGS. 3 and 4 show one preferred razor handle to which the flexible member and razor cartridge of FIGS. 1 and 2 may be attached. The shaving assembly 54 includes a handle 56, preferably made of a resilient plastic material or metal, having an upper end 58 and a lower end 60 remote therefrom. The handle 56 may comprise two handle halves, a rear handle portion 62 and a front handle portion 64, that are preferably connected together. The rear handle portion 64 includes annular ribs 66 on an exterior surface thereof for enhancing the gripability of the handle 56. In other preferred embodiments, the handle may comprise a single piece of molded plastic or metal. In still other preferred embodiments, the handle may be integrally formed with the flexible member.

Figure 5:
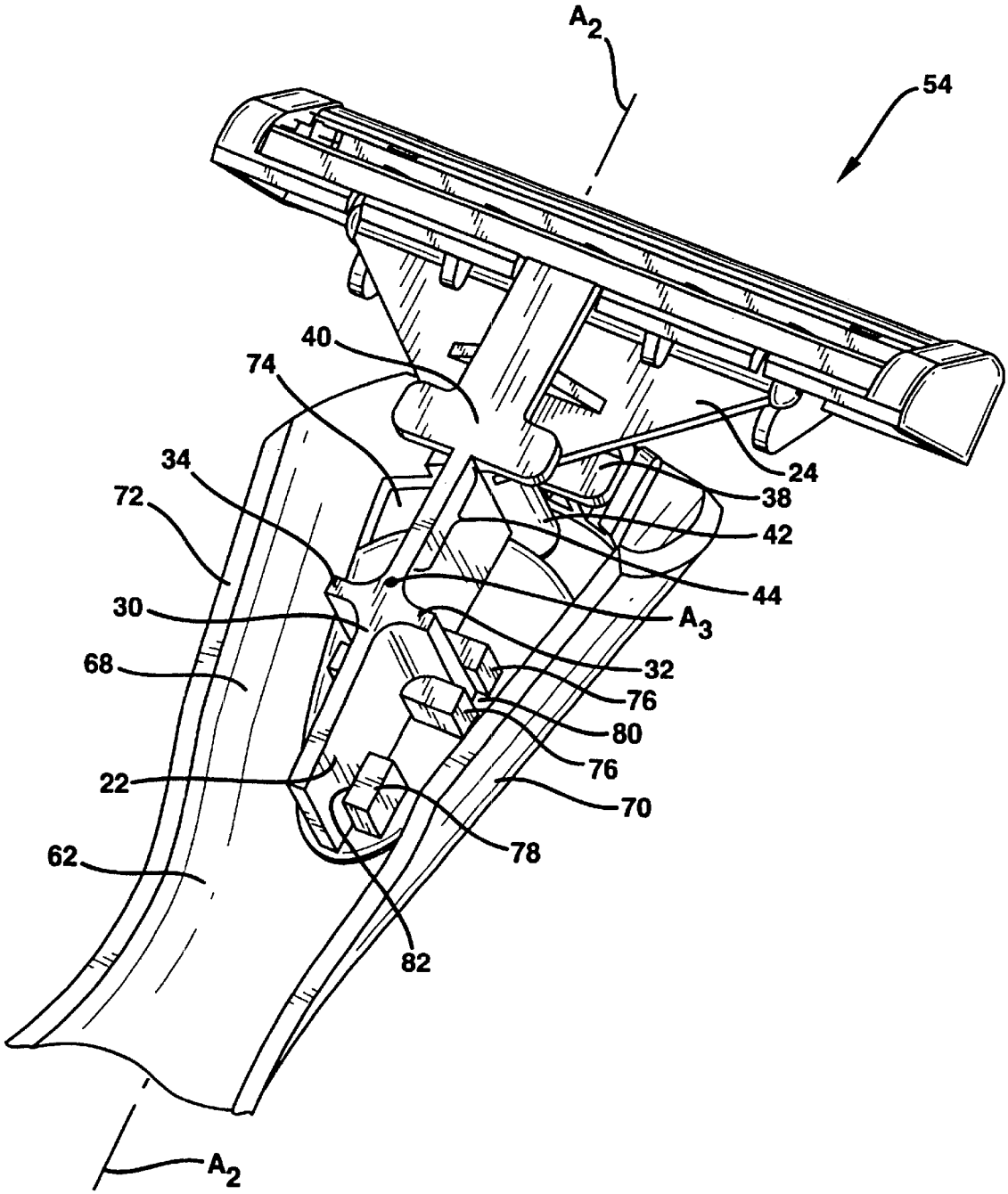
FIG. 5 shows a fragmentary isometric front side view of the razor assembly shown in FIGS. 3 and 4 shown with a front portion of the razor handle removed.

FIG. 5 shows a fragmentary, isometric view of the razor assembly 54 of FIGS. 3 and 4, including rear handle portion 62. The rear handle portion 62 includes an interior surface 68, an exterior surface 70, and an edge 72 extending between the interior and exterior surfaces 68, 70. The rear handle portion 62 may have an arcuate slot 74 extending from the interior surface 68 to the exterior surface 70 through which the visual indicator 42 may pass. As the razor cartridge and the second end of the flexible member 20 swivel about the pivot point centered at axis $A_3$, the visual indicator 42 moves along an arcuate path defined by the arcuate slot 74. The rear handle portion 62 preferably includes upper supports 76 and lower supports 78 for receiving the left and right side lateral supports 32 and 34, and the first end 22 of the flexible member. The upper supports 76 define a slot 80 for receiving the left side lateral support 32 and the right side lateral support 34. The lower supports 78 define a slot 82 for receiving the first end 22 of the flexible member 20. The upper and lower supports 76 and 78 provide engagement surfaces and/or points of contact for connecting the flexible member 20 to the handle while enabling the flexible web portion 44 of the flexible member 20 to swivel and/or rotate about respective axes $A_2$ and $A_3$. Thus, once the flexible member 20 is connected to the handle, all swiveling and torsional motion of the flexible member 20 preferably takes place in the flexible web 44 that extends from axis $A_3$ to the lower end of the upper flange 38 and support gussets 36A, 36B.

The flexible member 20 includes lower flange 40 that confronts the interior surface 84 of front handle portion 64 (FIG. 6), and an upper flange 38 that confronts the interior surface 68 of the rear handle portion 62. The upper flange 38 and the lower flange 40 cooperate together with the respective interior surfaces 68 of the rear handle portion 62 and the interior surface 84 of the front handle portion 64 to limit the degree of torsional movement of the second end 24 of the flexible member 20.

Figure 6:
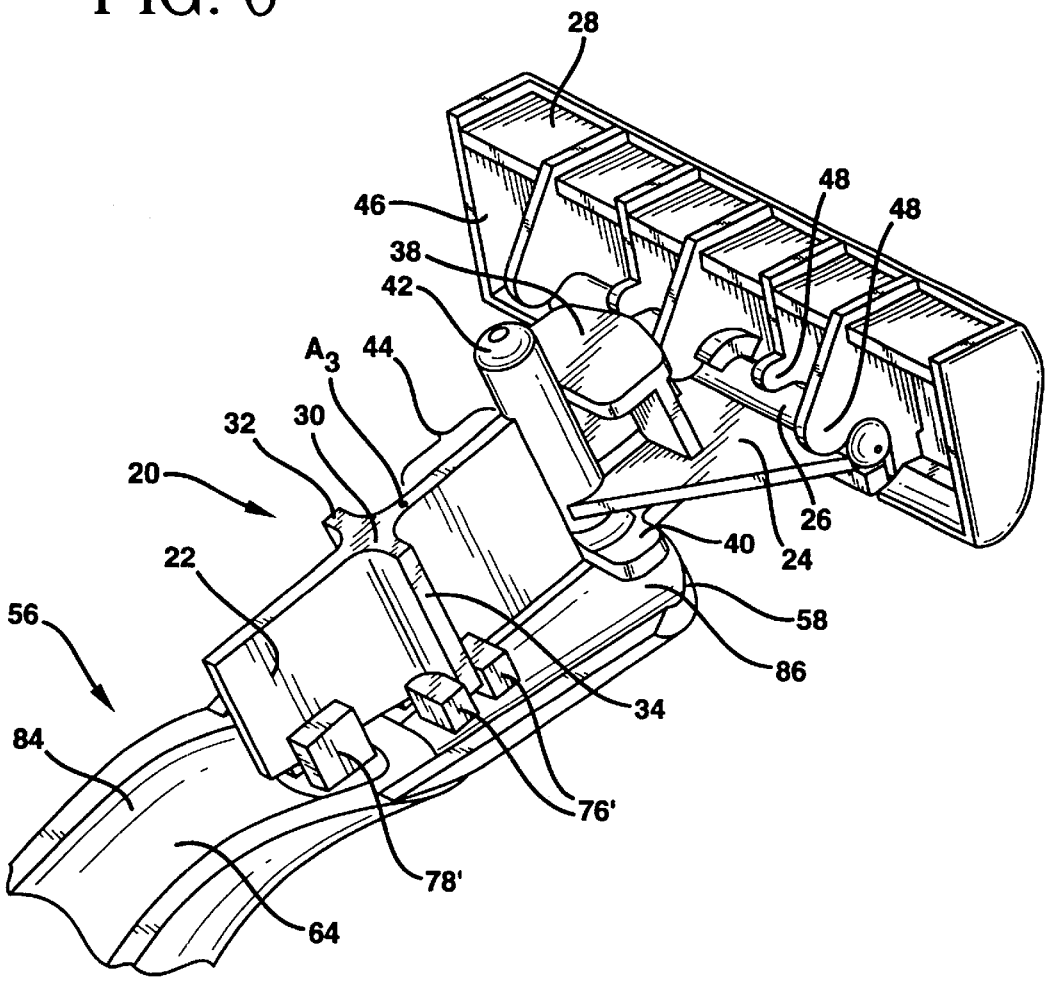
FIG. 6 shows a fragmentary isometric front side view of the razor assembly shown in FIGS. 3 and 4 shown with a rear portion of the razor handle removed.

FIG. 6 shows a fragmentary, isometric view of the razor assembly 54 of FIGS. 3 and 4, including front handle portion 64. The front handle portion 64 includes interior surface 84. The interior surface 84 of front handle portion 64 includes upper supports 76' and lower supports 78' that are substantially similar in shape and size to the upper and lower supports of the rear handle portion (FIG. 5). The upper supports 76 and 76' secure the left and right side supports 32, 34 of the lateral support 30 of the flexible member. The lower supports 78 and 78' secure the first or lower end 22 of the flexible member. Lower flange 40 is engageable with interior bearing surface 86 of the front handle portion 64. The lower flange 40 slides over the interior bearing surface 84 during swiveling movement of the razor cartridge.

Figure 7A:
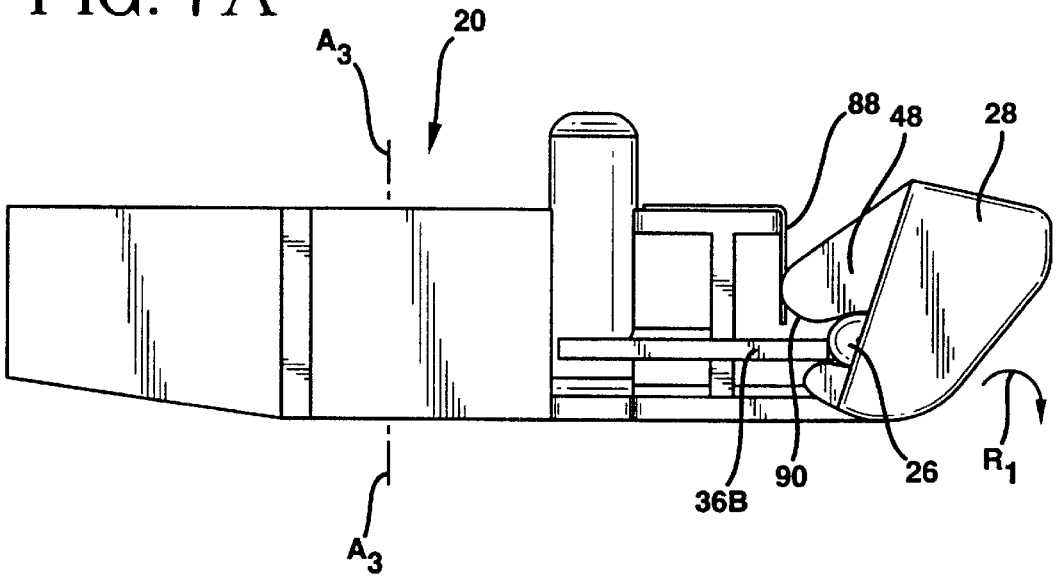
FIG. 7A shows a fragmentary right side view of a razor assembly including a flexible member with an unidirectional pivoting system for a razor cartridge, in accordance with certain preferred embodiments of the present invention.
Figure 7B:
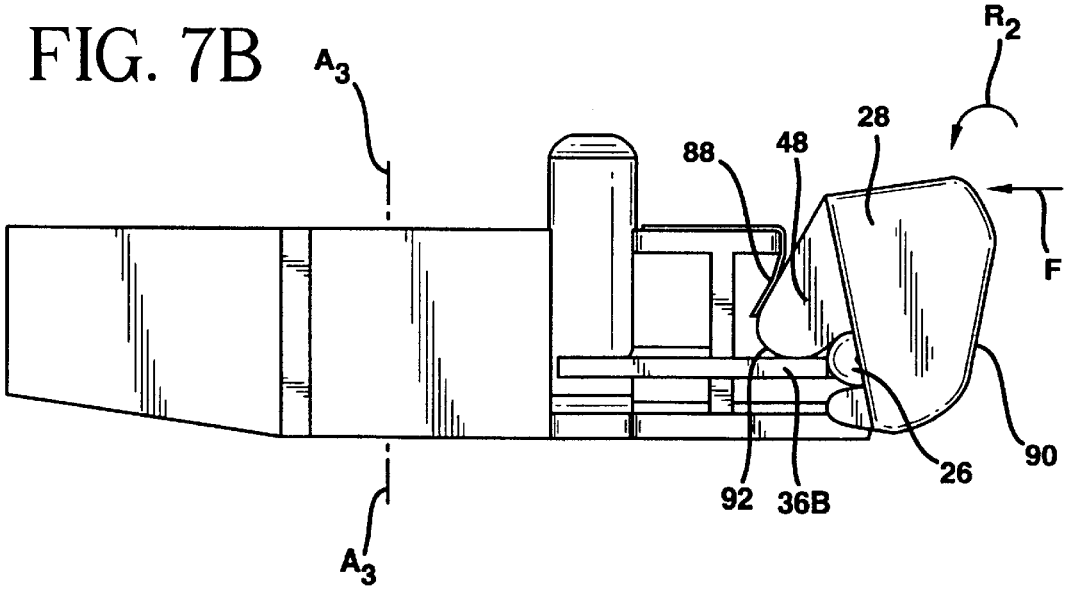
FIG. 7B shows the razor assembly of FIG. 7A with the razor cartridge in a deflected position.

FIGS. 7A and 7B show pivotal movement of the razor cartridge 28 relative to the flexible member 20 during a shaving operation. The embodiment shown in FIGS. 7A and 7B provides for unidirectional pivotal movement of the razor cartridge relative to the rod 26 of the flexible member 20. FIG. 7A shows the razor cartridge 28 in a normally extended or first pivotal position, with biasing element 88 urging the razor cartridge 28 to pivot about rod 26 in a clockwise direction $R_1$. Referring to FIG. 7B, during a shaving operation, external forces F applied to a top side 90 of the razor cartridge 28 cause the razor cartridge to pivot in a counter-clockwise direction $R_2$ about the rod 26. As the razor cartridge pivots from the position shown in FIG. 7A to the position shown in FIG. 7B, the biasing element 88 is compressed. After the force F is removed from the top side 90 of the razor cartridge 28, the biasing element 88 decompresses for returning the razor cartridge to the extended position shown in FIG. 7A. Thus, once the force F is greater than the counterforce exerted by biasing element 88, the razor cartridge will pivot from the normally extended position shown in FIG. 7A, to the retracted position shown in FIG. 7B. Pivotal movement in the counter-clockwise direction $R_2$ continues until the rearward portion 92 of bearing surface 48 engages the support gussets 36A and 36B (FIGS. 7A and 7B show gussset 36B) of the flexible member 20. Once the force F is removed from the top side 90 of the razor cartridge 28, the biasing element 88 urges the razor cartridge 28 to pivot back to the normally extended position shown in FIG. 7A.

Figure 8A:
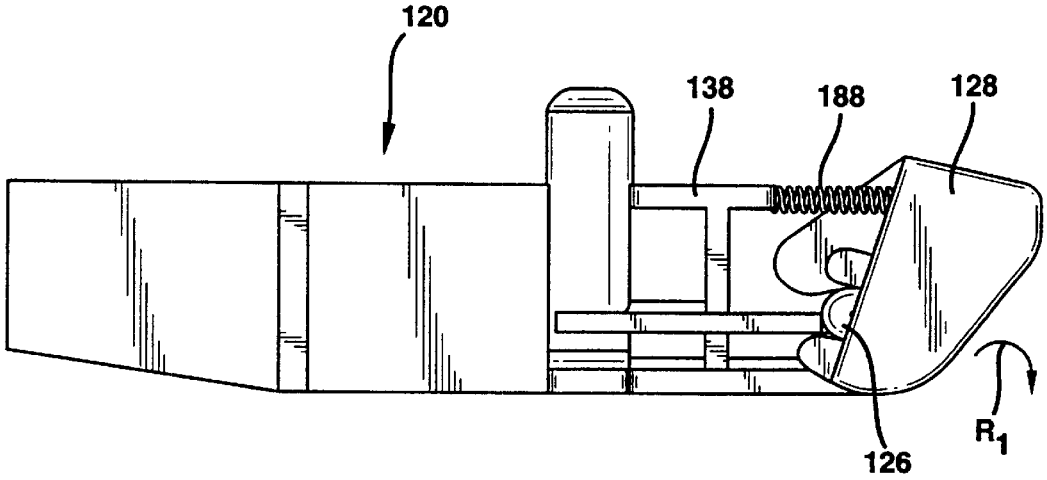
FIG. 8A shows a fragmentary right side view of a razor assembly including a flexible member with a unidirectional pivoting system for a razor cartridge, in accordance with further preferred embodiments of the present invention.
Figure 8B:
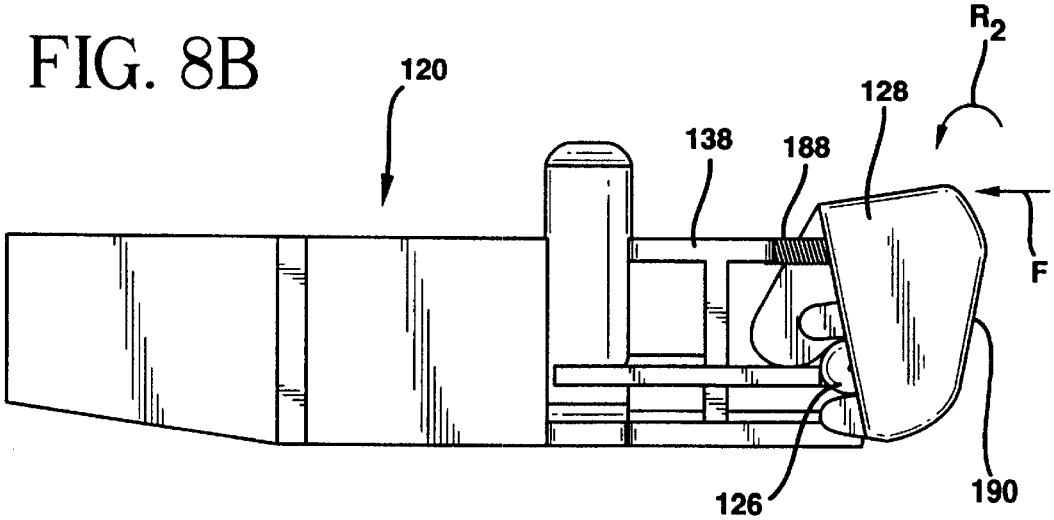
FIG. 8B shows the razor assembly of FIG. 8A with the razor cartridge in a deflected position.

FIGS. 8A and 8B show pivotal movement of a razor cartridge relative to a flexible member, in accordance with further preferred embodiments of the present invention. The flexible member 120 includes a helical spring 188 attached to an upper end of upper flange 138. The razor cartridge 128 is pivotally mounted to substantially cylindrical rod 126. In FIG. 8A, the helical spring 188 urges the razor cartridge 128 into an extended position. When force F is exerted upon the top side 190 of razor cartridge 128, the razor cartridge pivots about the substantially cylindrical-shaped rod in the direction counter-clockwise $R_2$, thereby compressing the helical spring 188. When the force F is removed from the top side 190 of razor cartridge 128, the helical spring 188 decompresses and urges the razor cartridge 128 to pivot about the rod 126 in the direction clockwise $R_1$. Thus, once the force F is removed, the helical spring 188 urges the razor cartridge 128 back into the extended position shown in FIG. 8A.

Figure 9A:
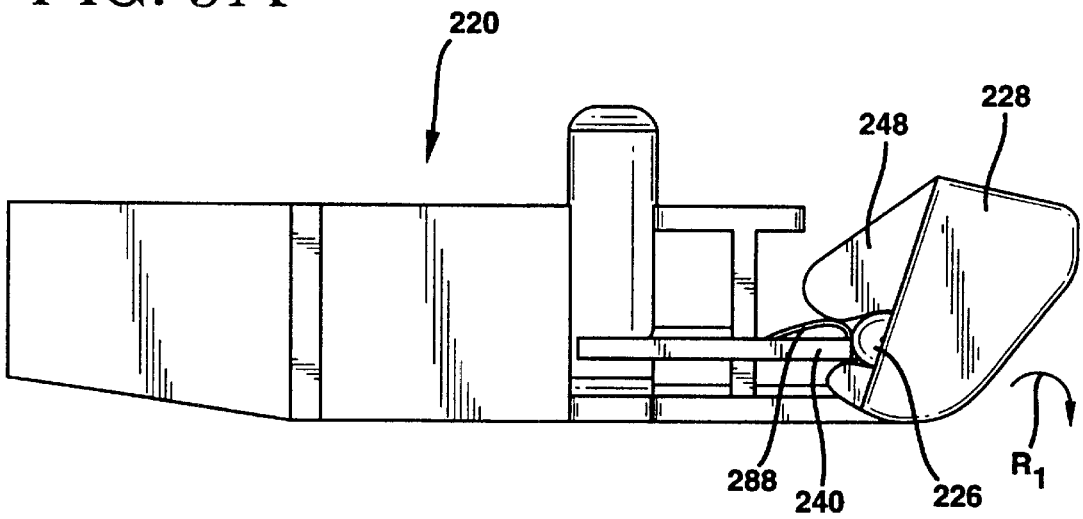
FIG. 9A shows a fragmentary right side view of a razor assembly including a flexible member with an unidirectional pivoting system for a razor cartridge, in accordance with still further preferred embodiments of the present invention.
Figure 9B:
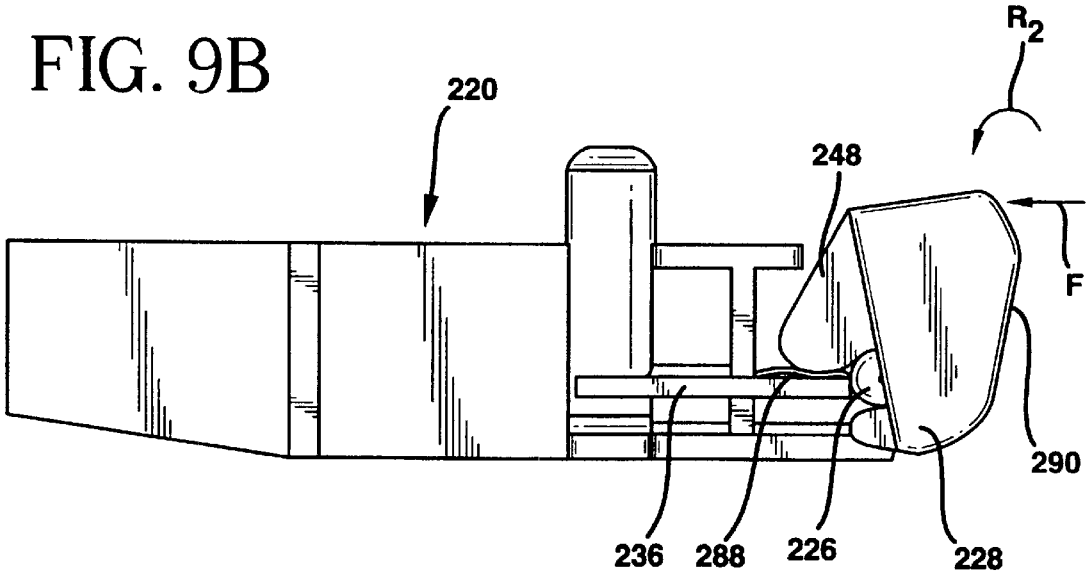
FIG. 9B shows the razor assembly of FIG. 9A with the razor cartridge in a deflected position.

FIGS. 9A and 9B show a flexible member 220 for a shaving assembly in accordance with another preferred embodiment of the present invention. The flexible member 220 has a razor cartridge 228 pivotally mounted thereto for unidirectional pivot movement about cylindrical rod 226.

The flexible member 220 has a biasing element 288 integrally molded thereto for urging the razor cartridge 228 to pivot in a clockwise direction $R_1$ about cylindrical rod 226 to the extended position shown in FIG. 9A. When a force F is exerted upon the top side 290 of the razor cartridge 228, the razor cartridge pivots about the rod 226 in the counter-clockwise direction $R_2$ to compress the biasing element 288. The razor cartridge pivots in the counter-clockwise direction $R_2$ until bearing surface 248 engages support gusset 236. When the force F is removed from the top side 290 of the razor cartridge 228, the biasing element 288 decompresses for urging the razor cartridge 228 to pivot about the rod in clockwise direction $R_1$ to return the razor cartridge to the extended position shown in FIG. 9A.

Figure 10A:
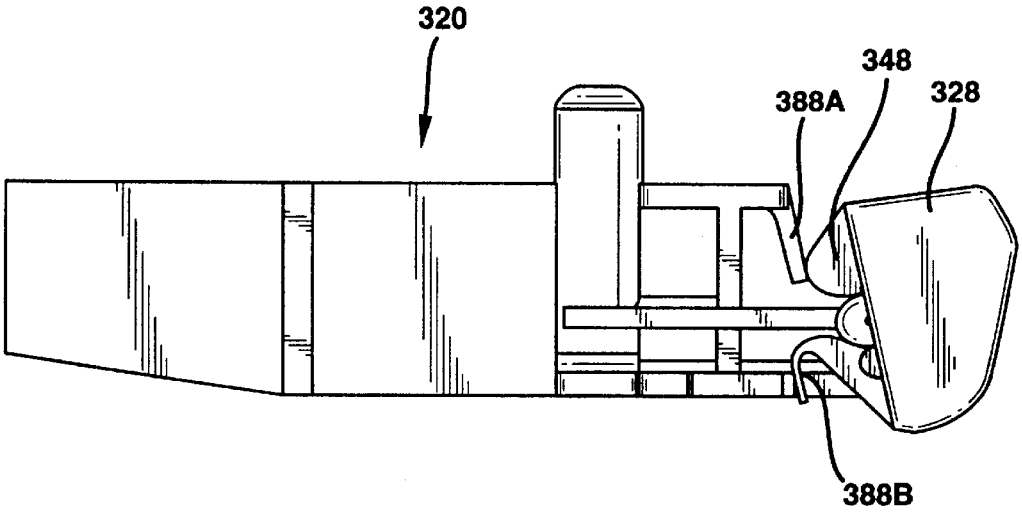
FIG. 10A shows a fragmentary right side view of a razor assembly including a flexible member with a bi-directional pivoting system for a razor cartridge, in accordance with yet further preferred embodiments of the present invention.
Figure 10B:
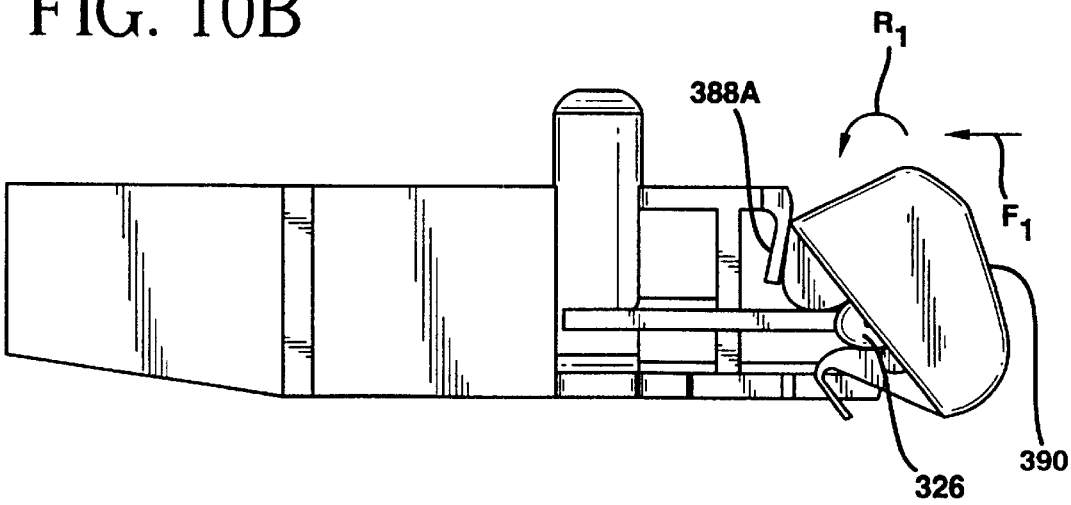
FIG. 10B shows the razor assembly of FIG. 10A with the razor cartridge in a first deflected position.
Figure 10C:
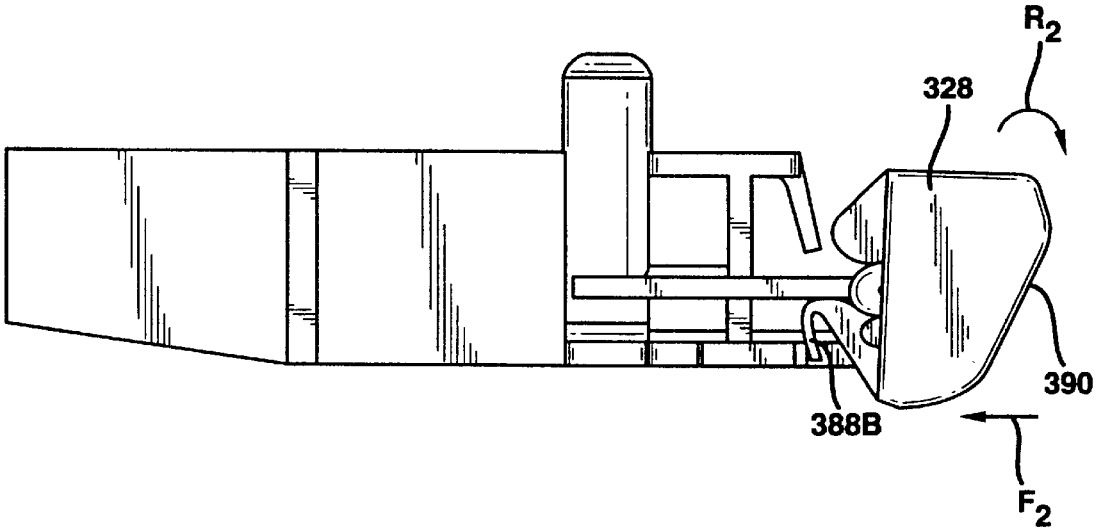
FIG. 10C shows the razor assembly of FIGS. 10A and 10B with the razor cartridge in a second deflected position.

FIGS. 10A–10C show yet another embodiment of a flexible member for a razor assembly whereby the flexible member includes a bi-directional pivoting system. Referring to FIG. 10A, the flexible member 320 has a first biasing element 388A extending from upper flange 338 to engage the bearing surface 348 at the under side of razor cartridge 328. The razor cartridge also includes a second biasing element 388B engagable with lower flange 340. The first and second biasing elements 388A, 388B normally urge the razor cartridge 328 into the neutral position shown in FIG. 10A. Referring to FIG. 10B, when a force $F_1$ is exerted upon the top side 390 of razor cartridge 328, the razor cartridge 328 rotates in a counterclockwise direction $R_1$ about rod 326, thereby compressing first biasing element 328A. When the force $F_1$ is removed, the first biasing element 388A urges the razor cartridge to rotate in a clockwise direction $R_2$ back into the neutral position shown in FIG. 10A. Referring to FIG. 10C, when a force $F_2$ is directed on the top side 390 of razor cartridge 328, the razor cartridge rotates in a clockwise direction $R_1$ designated $R_2$ so as to compress the second biasing element 388B. When the force $F_2$ is removed, the second biasing element 388B urges the razor cartridge 328 to rotate in a counterclockwise direction and back to the neutral position shown in FIG. 10A. Thus, the embodiment shown in FIG. 10A–10C provides for a razor cartridge that is able to pivot in two directions (i.e., bi-directional pivoting). The biasing elements 388A, 388B return the razor cartridge to a neutral position once external forces have been removed from the razor cartridge.

The razor cartridge 28 and flexible member 20 (FIG. 1) of the present invention may also undergo swiveling and torsional movement when external forces are applied to the razor cartridge 28. FIG. 2 shows swiveling movement of the flexible member 20. While the first end 22 of the flexible member 20 is secured in place between upper and lower handle portions 62 and 64, the flexible web 44 (i.e., the section of the flexible member 20 between the pivot point defined by axis $A_3$ and the upper flange 38) is able to flex in the directions indicated by the arrows relative to axis $A_3$ of the flexible member 20. In other words, the portion of the flexible member 20 at the visual indicator will move along an arcuate path centered on axis $A_3$.

Figure 11:
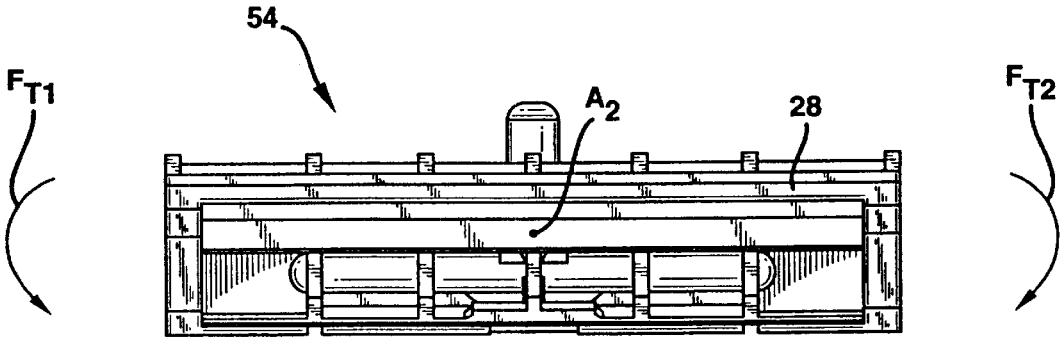
FIG. 11 shows a top plan view of the razor assembly shown in FIGS. 3 and 4 depicting the range of torsional movement of the razor cartridge.

FIG. 11 is a top plan view of the razor assembly 54 of FIGS. 5 and 6 showing torsional movement of the flexible member 20 in response to torsional forces $F_{t1}$ and $F_{t2}$ exerted upon the razor cartridge 28. The torsional movement is essentially rotational movement of the razor cartridge about the longitudinal axis $A_2$of the flexible member 20. The longitudinal axis $A_2$ of the flexible member 20 shown in FIG. 11 extends into and out of the paper. The torsional movement of the flexible member preferably occurs between the upper and lower flanges 38, 40 and the cartridge attachment axis $A_1$.

Figure 12A:
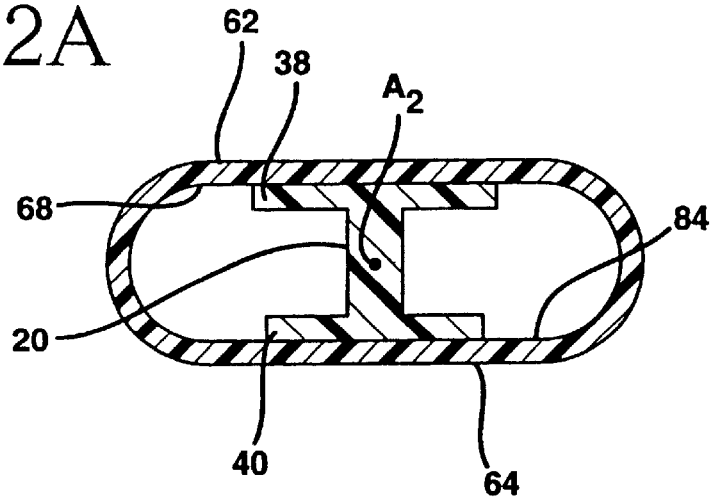
FIG. 12A shows a fragmentary cross-sectional view of the razor assembly of FIG. 1 with the flexible member in a neutral, undeflected position relative to a handle.
Figure 12B:
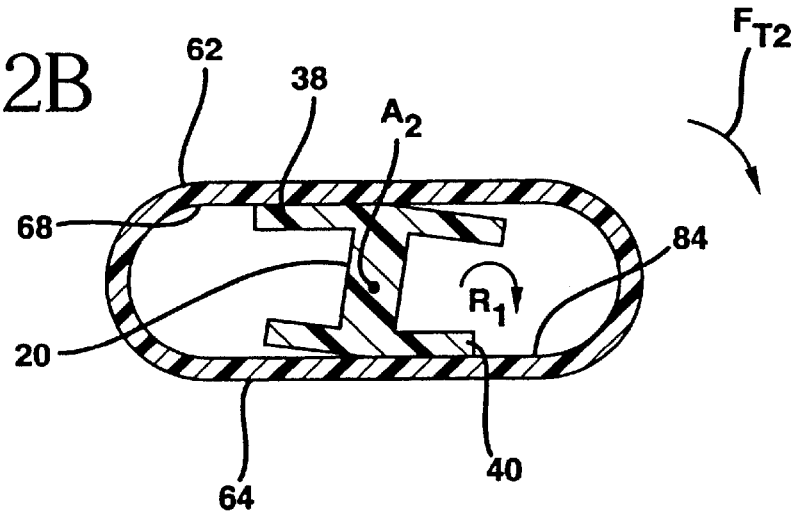
FIG. 12B shows the razor assembly of FIG. 9A with the flexible member in a first torsional movement position relative to the handle.
Figure 12C:
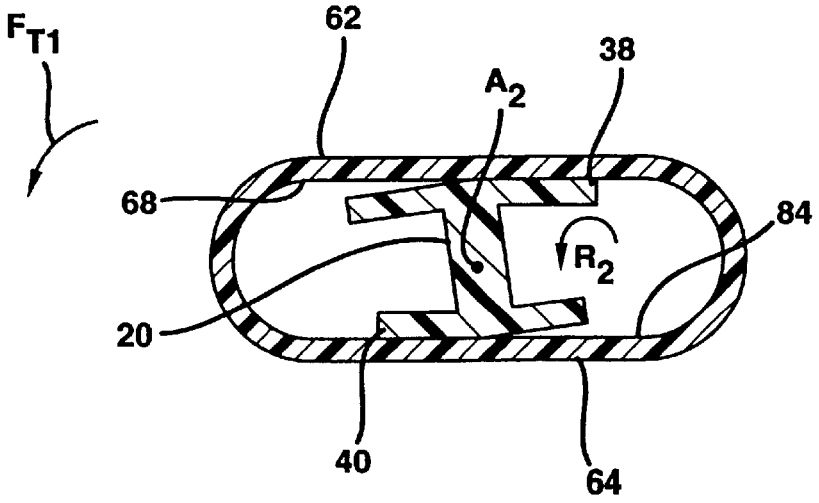
FIG. 12C shows the razor assembly of FIG. 9A with the flexible member in a second torsional movement position relative to the handle.

FIGS. 12A–12C show torsional movement of flexible member 20. FIG. 12A shows a fragmentary cross-sectional view of the razor assembly 54 of FIGS. 3 and 4 including rear handle portion 62 having interior surface 68, and front handle portion 64 including interior surface 84. In FIG. 12A there are no torsional forces acting upon flexible member 20. As a result, the upper and lower flanges 38 and 40 exert no pressure load on the respective interior surfaces 68 and 84. FIG. 12B shows the flexible member 20 after torsional forces $F_{t2}$ have caused the flexible member 20 to twist and rotate in a clockwise direction $R_1$ about the longitudinal axis $A_2$ and relative to the handle.

FIG. 12C shows the flexible member 20 after torsional forces $F_{t1}$ have caused the flexible member 20 to rotate in a counterclockwise direction $R_2$ about the longitudinal axis $A_2$ of the flexible member 20. Torsional movement of flexible member 20 (i.e., rotation of the second end 24 of the flexible member 20 relative to the first end 22 of the flexible member about the longitudinal axis $A_2$ of the flexible member 20) is limited by the increasing stiffness of the cross-sectional geometry of the flexible member 20 as it deforms when torsional forces are applied. This stiffness is a result of the geometry (polar moment of inertia) and the material properties (shear modulus) of the flexible member 20.

Figure 13A:
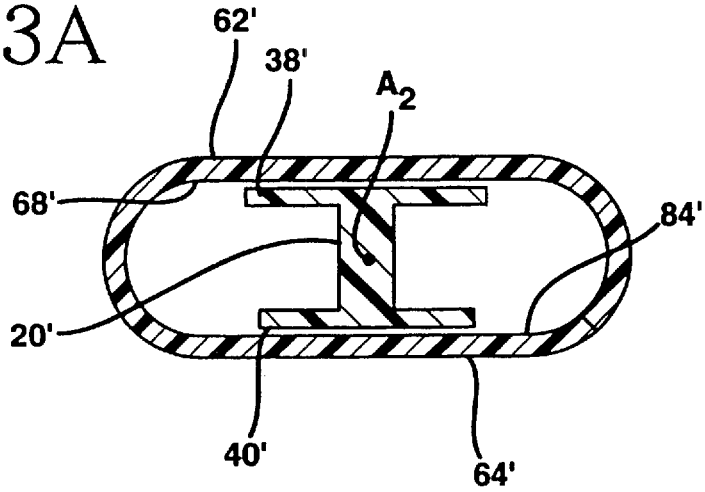
FIG. 13A shows a fragmentary cross-sectional view of a razor assembly with a flexible member in a neutral, undeflected position relative to a handle, in accordance with further preferred embodiments of the present invention.
Figure 13B:
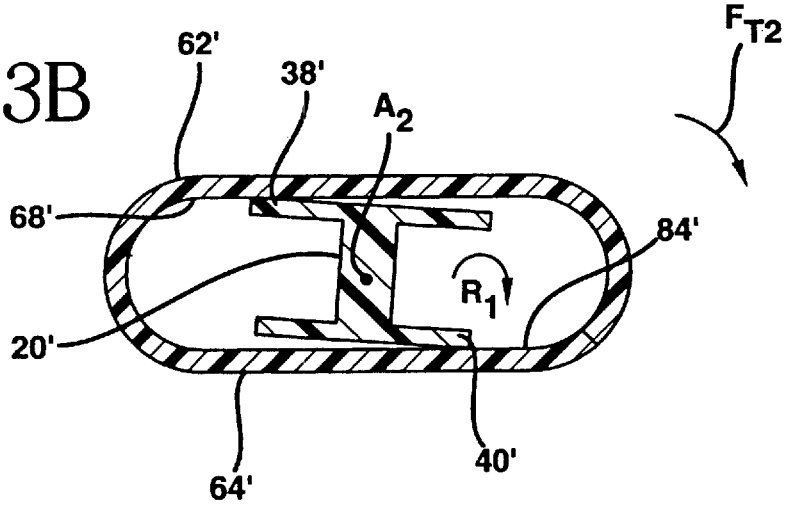
FIG. 13B shows the razor assembly of FIG. 13A with the flexible member in a first torsional movement position relative to the handle.
Figure 13C:
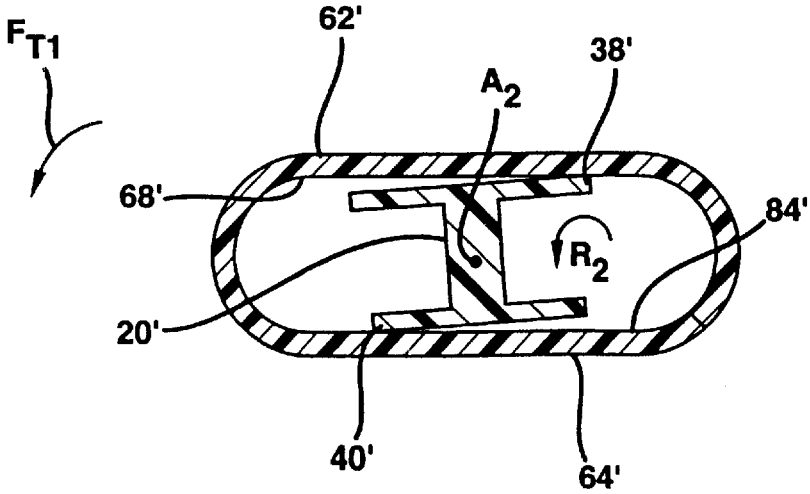
FIG. 13C shows the razor assembly of FIG. 13A with the flexible member in a second torsional movement position relative to the handle.

Referring to FIG. 13A, in other preferred embodiments of the present invention, a first gap may be present between upper flange 38' and the interior surface 68' of rear handle portion 62', and a second gap may be present between lower flange 40' and the interior surface 84' of front handle portion 64'. Torsional movement is also limited by the upper flange 38' engaging the interior surface 68' of rear handle portion 62' (FIG. 13B) and/or the lower flange 40' engaging the interior surface 84' of front handle portion 64' (FIG. 13C). In this embodiment, torsional movement of flexible member 20' may also be limited by the increasing stiffness of the cross-sectional geometry of the flexible member 20' as it deforms when torsional forces are applied.

Figure 14A:
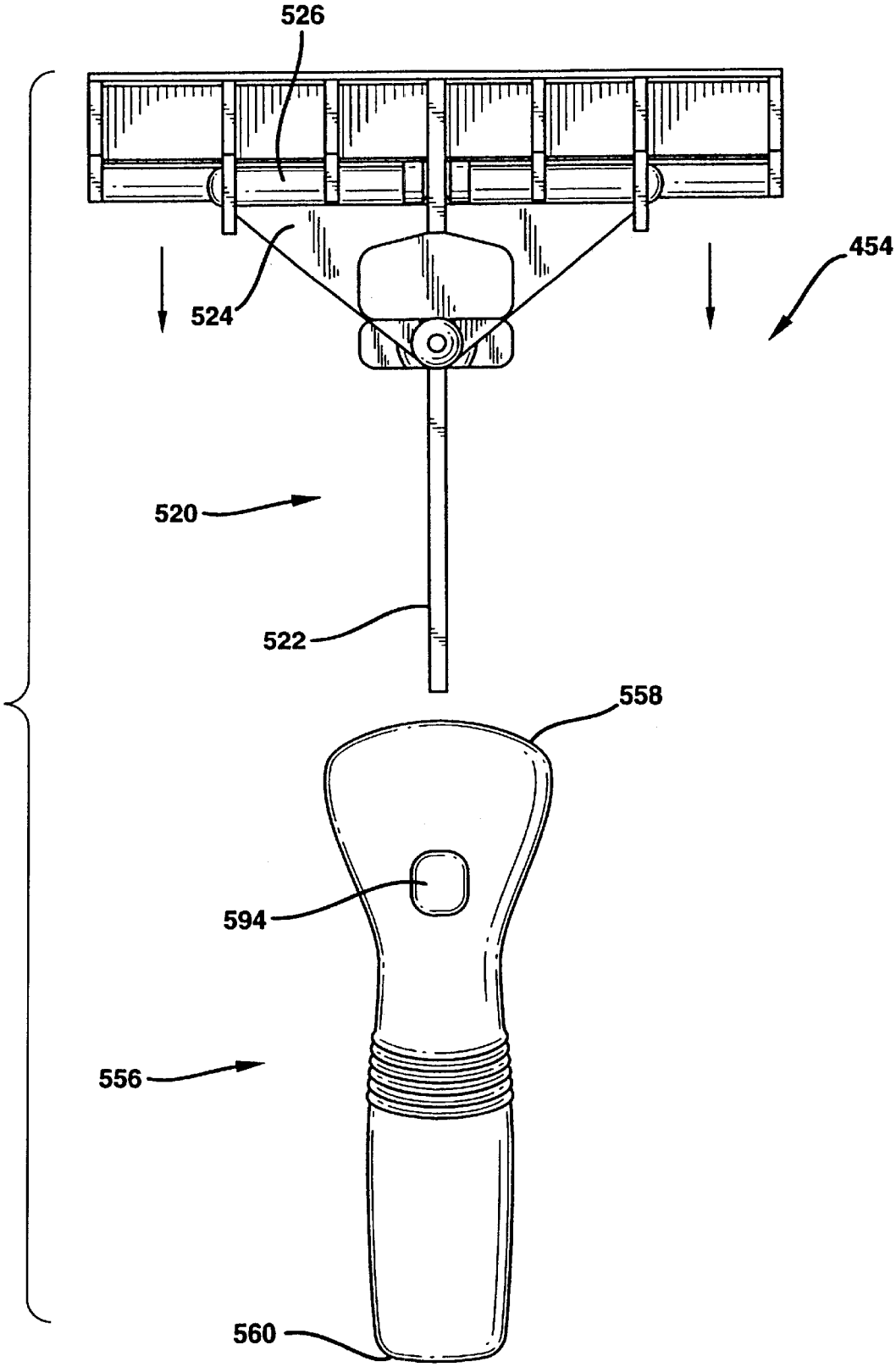
FIG. 14A shows an exploded rear view of a shaving assembly having a releasably attached flexible member, in accordance with further preferred embodiments of the present invention.
Figure 14B:
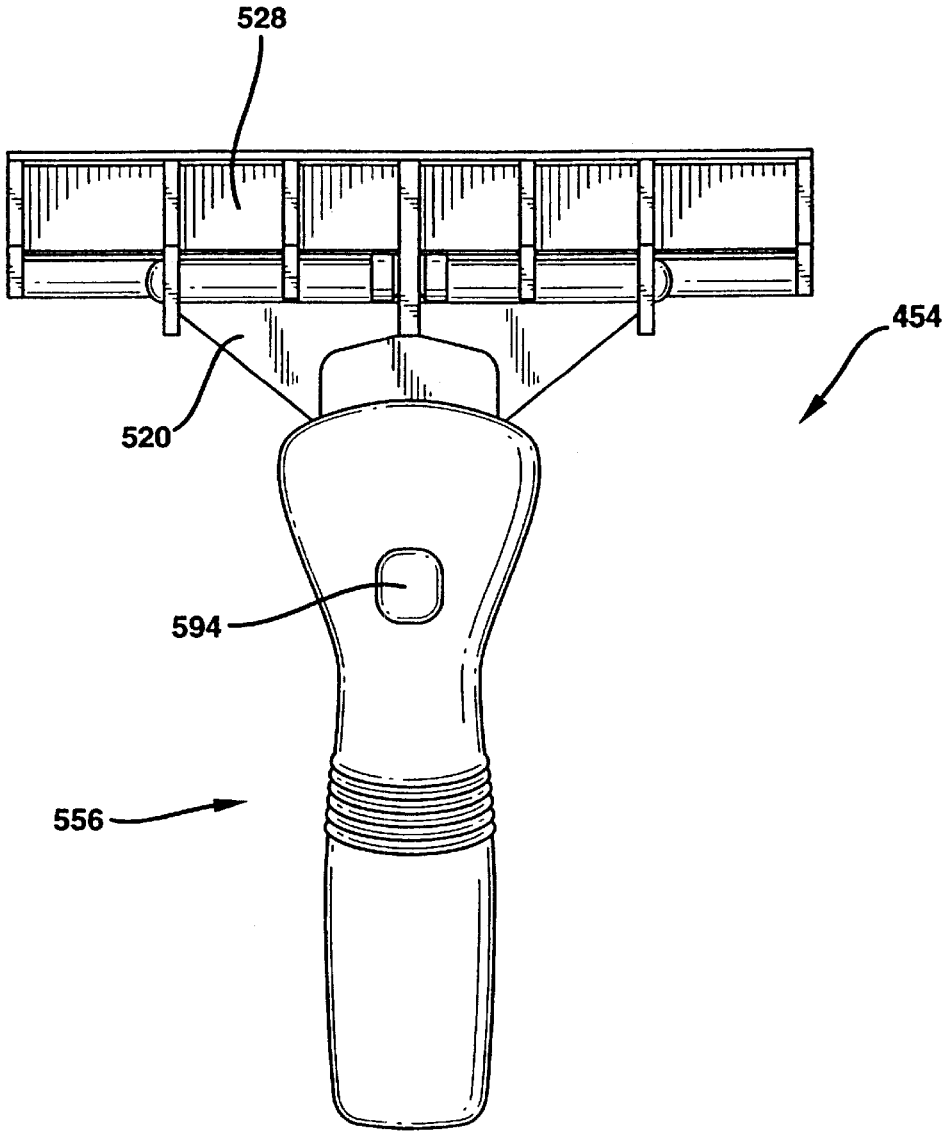
FIG. 14B is a rear view of the flexible member of FIG. 14A shown releasably attached to the handle.

FIGS. 14A and 14B show a shaving assembly 454 including a flexible member 520 capable of being releasably attached to a handle 556. The flexible member 520 includes a lower end 522, an upper end 524 remove therefrom and cylindrical rod 526 connected to the upper end 524 of flexible member 520. The handle 556 includes an upper end 558 having an opening (not shown) and a lower end 560 remote therefrom. The handle-also includes a button 594 that may be depressed for releasing the flexible member from its connection with the handle 556, as will be described in more detail below. In order to connect the flexible member 520 with the handle 556, the lower end 522 of the flexible member is inserted into the opening at the upper end 558 of the handle. The interior region of the handle may include any one of a number of well known structures for securing a shaft to razor handle. For example, the interior region of the handle may include a spring loaded element for engaging the outer surface of the lower end 522 of flexible member 520 when the flexible member is inserted into the opening of the handle 556.

FIG. 14B shows the flexible member 520 after it has been connected to handle 556. The flexible member 520 has razor cartridge 528 pivotally connected thereto. The flexible member 520 will remain attached to handle 556 until button 594 is depressed for releasing flexible member 520 from its attachment to handle 556. After flexible member 520 has been detached from handle 556, a replacement flexible member may be releasably attached to handle 556. In certain preferred embodiments, the flexible member 520 may be disposable. In other words, the flexible member 520 may be sold with one or more razor cartridges 528 and the entire subassembly of the flexible member and razor cartridge thrown away once the cutting blades of razor cartridge 528 have become worn. However, in other embodiments, the flexible member may be sold separately from razor cartridges. In these embodiments, it may be desirable to replace the flexible member 520 once it loses its flexibility and/or resilience, irrespective of whether or not one or more razor blade cartridges connected thereto have become worn.

Although the invention herein has been described with reference to particular embodiments, it is to be understood that the embodiments are merely illustrative of principles and applications of the present invention. Thus, it is understood that various modifications may be made to the embodiments disclosed herein without departing from the spirit and scope of the present invention as defined by the claims.

What is claimed is:

1. A razor assembly comprising:

a handle; and a flexible member having a first end connected to said handle at a pivot point, a second free end projecting from the upper end of said handle and a longitudinal axis extending through the first and second ends of said flexible member, the second free end of said flexible member including a substantially cylindrical rod extending in a direction that intersects the longitudinal axis of said flexible member; the second free end of said flexible member being movable along an arcuate path centered at the pivot point and rotatable about an axis substantially parallel to the longitudinal axis of said flexible member, the second free end of the flexible member being adapted to receive a razor cartridge pivotally connected thereto, the razor cartridge having a major axis and one or more razor blades.

2. A razor assembly comprising:

a handle; and a flexible member having a first end connected to said handle at a pivot point, a second free end projecting from the upper end of said handle, a longitudinal axis extending through the first and second ends, and a substantially cylindrical rod extending in a direction that intersects the longitudinal axis of the flexible member; and a razor cartridge having a major axis and including one or more razor blades, each of said one or more razor blades including a cutting edge extending in a direction substantially parallel to the major axis of the razor cartridge, said razor cartridge being pivotally connectable to the second free end of said flexible member for pivoting about an axis that is substantially parallel to the major axis of said razor cartridge, wherein the second end of said flexible member and the razor cartridge pivotally connected thereto are movable along an arcuate path centered on the pivot point, and wherein said second end of said flexible member and said razor cartridge are rotatable about an axis substantially parallel to the longitudinal axis of said flexible member.

3. A razor assembly comprising:

a handle;

a flexible member having a first end connected to said handle at a pivot point, a second free end projecting from the upper end of said handle and a longitudinal axis extending through the first and second ends, said flexible member; wherein the second free end of said flexible member is movable along an arcuate path centered at the pivot point and is rotatable about an axis substantially parallel to the longitudinal axis of said flexible member, said handle including a rear handle portion and a front handle portion, said rear and front handle portions being connectable together for securing at least a portion of the flexible member, the connected rear and front handle portions surrounding at least the first end of said flexible member.

4. A razor assembly comprising:

a handle;

a flexible member having a first end connected to said handle at a pivot point, a second free end projecting from the upper end of said handle and a longitudinal axis extending through the first and second ends, said flexible member including a laterally extending support having an axis intersecting the longitudinal axis of said flexible member, said laterally extending support lying between the pivot point and the first end of said flexible member, said handle including a rear handle portion and a front handle portion, said rear and front handle portions being connectable together for securing at least a portion of the flexible member, said rear and front handle portions surrounding at least the first end of said flexible member; and a razor cartridge having a major axis and including one or more razor blades, said razor cartridge being pivotally connectable to the second free end of said flexible member for pivoting about an axis that is substantially parallel to the major axis of said razor cartridge, wherein the second end of said flexible member and the razor cartridge pivotally connected thereto are movable along an arcuate path centered on the pivot point, and wherein said second end of said flexible member and said razor cartridge are rotatable about an axis substantially parallel to the longitudinal axis of said flexible member.

5. The razor assembly as claim in claim 1, wherein each of said one or more razor blades includes a cutting edge extending in a direction substantially parallel to the major axis of the razor cartridge.

6. The razor assembly as claimed in claim 1, wherein said razor cartridge has an underside including one or more surfaces engagable with said substantially cylindrical rod for pivotally connecting said razor cartridge to said flexible member.

7. The razor assembly as claimed in claim 1, wherein said razor cartridge is pivotable about an axis that extends in a direction that is substantially parallel to the major axis of said razor cartridge.

8. The razor assembly as claimed in claim 1, wherein said flexible member includes a support gusset extending from the second free end toward the first end thereof.

9. The razor assembly as claimed in claim 3, wherein said flexible member includes a laterally extending support having an axis intersecting the longitudinal axis of said flexible member, said laterally extending support lying between the pivot point and the first end of said flexible member.

10. The razor assembly as claimed in claim 2, wherein said handle is a one piece handle.

11. The razor assembly as claimed in claim 2, wherein said flexible member is integrally molded with said handle.

12. The razor assembly as claimed in claim 9, wherein the rear handle portion has an interior face with an upper receiver channel and an lower receiver channel, the upper receiver channel being adapted to receive the laterally extending support of the flexible member and the lower receiver channel being adapted to secure a section of said flexible member adjacent the first end thereof.

13. The razor assembly as claimed in claim 12, wherein said rear handle portion has an arcuate slot extending from the interior face to an exterior surface thereof.

14. The razor assembly as claimed in claim 13, wherein said flexible member includes an indicator connected thereto and disposed between the first and second ends thereof, and wherein said indicator extends through said arcuate slot for indicating the location of said flexible member during shaving.

15. The razor assembly as claimed in claim 12, wherein the front handle portion has an interior face with an upper receiver channel and a lower receiver channel, the upper receiver channel being adapted to secure the laterally extending support of the flexible member and the lower receiver channel being adapted to receive a section of said flexible member adjacent the first end thereof.

16. The razor assembly of claim 1, wherein said handle comprises a thermoplastic material.

17. The razor assembly as claimed in claim 16, wherein said handle includes an exterior surface having one or more annular ribs so as to provide a gripping surface for said handle.

18. The razor assembly as claimed in claim 2, wherein said razor cartridge has an underside including one or more bearing surfaces engagable with said substantially cylindrical rod for pivotally connecting said razor cartridge to said flexible member.

19. The razor assembly as claimed in claim 2, wherein said flexible member includes a support gusset extending from the second free end toward the first end thereof.

20. The razor assembly as claimed in claim 2, wherein said flexible member includes a laterally extending support having an axis intersecting the longitudinal axis of said flexible member, said laterally extending support lying between the pivot point and the first end of said flexible member.

21. The razor assembly as claimed in claim 20, wherein said handle includes a rear handle portion and a front handle portion, said rear and front handle portions being connectable together for securing the flexible member to the handle.

22. The razor assembly as claimed is claim 20, wherein said handle is a one piece handle.

23. The razor assembly as claimed in claim 20, wherein said flexible member is integrally molded with said handle.

24. The razor assembly as claimed in claim 21, wherein the rear and front handle portions cooperate to surround at least the first end of said flexible member.

25. The razor assembly as claimed in claim 4, wherein the rear handle portion has an interior face with an upper receiver channel and a lower receiver channel, the upper receiver channel being adapted to receive the laterally extending support of the flexible member and the lower receiver channel being adapted to secure a section of said flexible member adjacent the first end thereof.

26. The razor assembly as claimed in claim 4, wherein said upper handle portion has an arcuate slot extending from the interior surface to an exterior surface thereof.

27. The razor assembly as claimed in claim 26, wherein said flexible member includes an indicator connected thereto and disposed between the first and second ends thereof, and wherein said indicator extends through said arcuate slot for indicating the location of said flexible member during shaving.

28. The razor assembly as claimed in claim 25, wherein the front handle portion has an interior face with an upper receiver channel and a lower receiver channel, the upper receiver channel being adapted to secure the laterally extending support of the flexible member and the lower receiver channel being adapted to receive a section of said flexible member adjacent the first end thereof.

29. A razor assembly comprising:

a handle; and a flexible member having a first end connected to said handle at a pivot point, a second free end projecting from the upper end of said handle for carrying a razor cartridge and a longitudinal axis extending through the first and second ends of said flexible member, said flexible member including a laterally extending support having an axis intersecting the longitudinal axis of said flexible member, said laterally extending support lying below the pivot point, the second free end of said flexible member being movable along an arcuate path centered at the pivot point and is rotatable about an axis substantially parallel to the longitudinal axis of said flexible member, said handle having an upper portion surrounding at least the first end of said flexible member.

* * * * *